US007766073B2

(12) United States Patent
Whealy

(10) Patent No.: US 7,766,073 B2
(45) Date of Patent: Aug. 3, 2010

(54) DIE-CASTING APPARATUS

(75) Inventor: Gregg Edward Whealy, Losantville, IN (US)

(73) Assignee: Delaware Machinery and Tool Company, Inc., Muncie, IN (US)

( * ) Notice: Subject to any disclaimer, the term of this patent is extended or adjusted under 35 U.S.C. 154(b) by 248 days.

(21) Appl. No.: 11/761,442

(22) Filed: Jun. 12, 2007

(65) Prior Publication Data

US 2008/0308250 A1 Dec. 18, 2008

(51) Int. Cl.
*B22D 17/26* (2006.01)
*B22D 33/04* (2006.01)

(52) U.S. Cl. ..... 164/343; 164/113; 164/137; 164/312; 164/340; 164/341

(58) Field of Classification Search ..... 164/340–343, 164/113, 137, 312
See application file for complete search history.

(56) References Cited

U.S. PATENT DOCUMENTS

| | | | | |
|---|---|---|---|---|
| 2,312,993 A | | 3/1943 | Stephens | 154/2 |
| 3,158,046 A | | 11/1964 | Steinfort et al. | 78/13 |
| 3,165,796 A | | 1/1965 | McDonald | |
| 3,433,292 A | | 3/1969 | McDonald | |
| 3,596,708 A | | 8/1971 | Lapin | |
| 4,206,799 A | | 6/1980 | McDonald | |
| 4,423,763 A | * | 1/1984 | Perrella | 164/316 |
| 4,981,168 A | | 1/1991 | Koch et al. | |
| 5,204,127 A | | 4/1993 | Prusha | |
| 5,210,997 A | | 5/1993 | Mountcastle, Jr. | 56/15.2 |
| 5,338,171 A | | 8/1994 | Hayakawa et al. | |
| 5,429,175 A | | 7/1995 | Thieman et al. | |
| 5,551,864 A | | 9/1996 | Boskovic | |
| 5,865,241 A | * | 2/1999 | Bishenden et al. | 164/137 |
| 6,000,322 A | | 12/1999 | To | 100/35 |
| 6,662,611 B2 | | 12/2003 | Janssen et al. | 72/55 |
| 6,761,208 B2 | | 7/2004 | Whealy et al. | 164/340 |
| 6,843,472 B2 | | 1/2005 | Henry, III et al. | 267/64.24 |
| 6,955,210 B2 | * | 10/2005 | Matsuura et al. | 164/339 |
| 7,669,639 B2 | * | 3/2010 | Whealy et al. | 164/340 |

OTHER PUBLICATIONS

Delaware Machinery and Tool Company, Inc. Drawing No. 20-281—Hydraulic Layout.

* cited by examiner

*Primary Examiner*—Jessica L Ward
*Assistant Examiner*—Devang Patel
(74) *Attorney, Agent, or Firm*—Brinks Hofer Gilson & Lione

(57) ABSTRACT

A die-casting die having a plurality of laterally movable slides is provided with a plurality of hydraulic cylinders located and carried internally within the die and connected with the plurality of slides to move the slides between cavity-open and cavity-closed positions.

17 Claims, 3 Drawing Sheets

DIE-CASTING APPARATUS

BACKGROUND OF THE INVENTION

The present invention relates to die-casting apparatus, and particularly to apparatus for forming die cast metal parts for various machines and products, including motor vehicles.

Die-casting is being used for the manufacture of larger and larger articles Large automotive parts such as internal combustion engine blocks and the housings for automatic transmissions are now commonly manufactured with die-casting as the first step in formation of the part. Such parts have extensive and complex surfaces with close tolerances; and die-casting permits their formation in high production, eliminating costly machining operations and saving metal. Die-casting requires extreme pressures exerted on the liquid metal and large amounts of heat are released from the molten metals as they cool and change state. Massive dies are required to maintain dimensional tolerances within specified limits to make such operations economically attractive and to provide the strength to withstand the stresses resulting from high pressures and forces. The die-casting molds for such large automotive parts as automatic transmission housings are, for example, frequently seven to eight feet (2.1-2.5 meters) tall, seven to eight feet (2.1-2.5 meters) wide, and six to seven feet (1.8-2.1 meters) thick when closed. The die-casting molds must be manufactured from high-grade, high-tensile strength steel.

Such dies frequently include one stationary element, one movable element operated by the die-casting machine to close the mold, and several slidable elements referred as "slides" that move transversely of the direction of movement of the die-casting machine to provide a mold cavity, which can provide intricate and re-entrant surface configurations. The mold slides, which slide transversely of the direction of movement of the die-casting machine, are generally moved by hydraulic cylinders to their proper positions. These hydraulic cylinders have typically extended laterally outward from the die-casting machine at right angles by an additional distance at least equal to the movement dimension of the slide. By way of example, such outwardly extending hydraulic cylinders used for movement of such slides can be seen unnumbered in U.S. Pat. No. 6,761,208, in U.S. Pat. No. 5,865,241 as cylinders 38*a* and 38*b*, in U.S. Pat. No. 4,206,799 as cylinders 55, in U.S. Pat. No. 3,596,708 as cylinders 66 and 68, and in U.S. Pat. No. 3,433,292 as cylinders 56, and on one occasion a die was placed in service having a pair of piston/cylinder units for one of its plurality slides carried within one of its die elements.

The length of a typical hydraulic cylinder used for movement of a slide in an automatic transmission housing or engine block can be as long as two feet or longer including its connections-with the source of hydraulic pressure. The hydraulic cylinders used for movement of such slides often extend laterally outwardly on all four sides of a die, sometimes imposing limitations in the die casting machines in which a die can be used. The hydraulic cylinders used for movement of such slides can thus contribute to the footprint of floor space occupied by a die-casting operation and are exposed to possible damage by nearby material handling and other industrial operations.

In addition, the long piston/cylinder units require heavy supporting structures extending outwardly from the die to not only carry the heavy piston/cylinder units but also withstand the stresses imposed on the supporting structures by the piston/cylinder units and their operations.

The hydraulic cylinders used for movement of such slides also require hydraulic couplings leading to flexible hoses typically attached at both ends of the hydraulic cylinders to provide for a typical double action of the pistons within the cylinders to cause both inward and outward motion of the slides with respect to the cavity in which the die-cast article is to be formed. The hoses and couplings are further coupled to valves and controllers that are located adjacent to the die-casting machine. The exposed hoses and couplings are thus also exposed to a variety of impacts and abrasions that can easily damage them to the point that any safety margin provided in prudent design can be exceeded and may result in a hydraulic failure, damage to the die, injuries to personnel, downtime and contribute to a whole range of consequences.

Furthermore, the hydraulic hoses are made from materials that expand when exposed to the high hydraulics pressures frequently encountered in die casting operations. For example, it is a common practice for operators of die casting dies to suddenly and repeatedly apply high pressure shocks to the hydraulic cylinders driving the slides to loosen and dislodge die cast parts that may not release from an open die cavity. The desired sudden application of high pressure to jar the stuck part from the mold cavity is dampened and delayed by the expansion of the hydraulic hoses, inhibiting the dislodging effect desired by the operator of the die.

Despite the various features and benefits of the prior die casting dies, there remains a need for a more compact, lighter and reliable die-casting die. There also remains a need for a die-casting die that has inherently higher safety margins that will reduce the number and severity of any hydraulic failures.

SUMMARY OF THE INVENTION

These several needs may be satisfied by providing a die-casting die having a plurality of laterally movable slides, with a plurality of hydraulic cylinders located and carried internally within the die and connected with the plurality of slides to move the slides between cavity-open and cavity-closed positions.

A die of the invention for casting a metal part can comprise, for example, a stationary die element including a cavity-forming surface for mounting on the stationary platen of a die casting machine; and a movable die element for mounting on a movable platen of a die casting machine for movement into cavity-forming engagement with the stationary die element, the movable die element including a cavity-forming surface portion, and carrying a plurality of slides including cavity-forming surfaces for movement substantially transversely with respect to the movement of the movable platen between cavity-forming and part-removal positions, and a plurality of hydraulic piston/cylinder units carried internally within the movable die element to drive the plurality of slides substantially transversely with respect to the movement of the movable platen between their cavity-forming positions and part-removable positions. Preferably the movable die element is also formed to include means for delivering hydraulic fluid from the hydraulic power source to the plurality of piston/cylinder units to move them between their cavity-forming and part-removable positions. Such a die of the invention can be lighter, have a substantially smaller profile, and deliver significantly greater forces for opening the slides and cavity than prior art dies and avoid limitations in the selection of die casting machines with which the die can be used.

In one application the invention also permits an inexpensive die for die casting a V-block for internal combustion engines, which may be operated by a wide range of die casting machines, including those with inadequate capacity to operate the heavy prior art dies used for large cast parts, by providing, in addition to the elements set forth above, at least a pair of cylinder-forming die core pieces carried by the movable die element for reciprocation at an acute angle with respect to the movement of the movable platen between extended positions within the die cavity and retracted positions removed from the die cavity and with die core locking means movably carried within the movable die element to a die core piece locking position. Such a V-block die-casting die is disclosed in U.S. Pat. No. 6,761,208, the disclosure of which is incorporated herein by reference.

Other features of the present invention and the corresponding advantages of those features will be apparent from the following discussion of the preferred embodiments of the present invention, exemplifying the currently known best mode of practicing the present invention, which is illustrated in the accompanying drawings. The components in the drawings are not necessarily to scale, and the drawings eliminate a showing of many details of an actual die, which will be apparent to those of ordinary skill, to more clearly illustrate the elements of the invention and their operation. In the figures the same referenced numerals designate corresponding parts throughout the different figures.

DESCRIPTION OF A PREFERRED EMBODIMENT OF THE INVENTION

Figure 1:
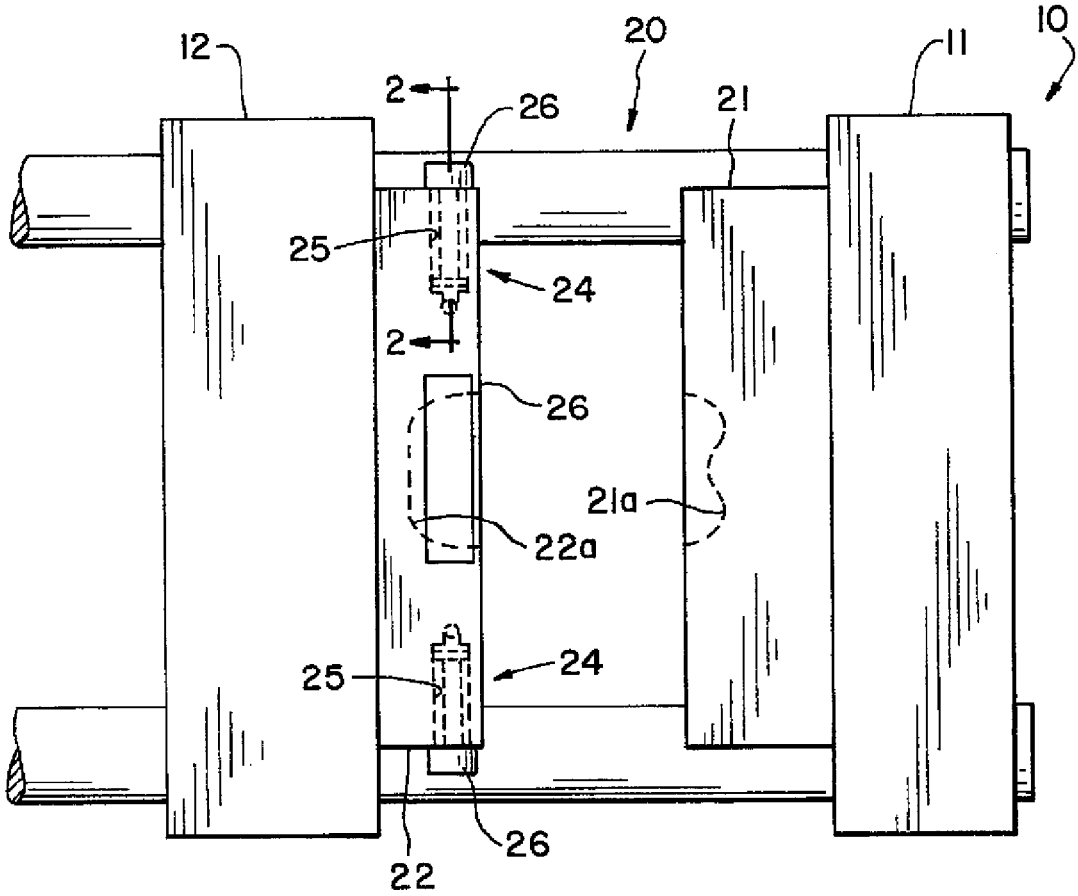
FIG. 1 is an illustration, from above, of a die of the invention mounted on the stationary and movable platens of a die casting machine in its die-open position, but with the plurality of slides in their die closed positions.

FIG. 1 illustrates, from above, a die 20 of the invention mounted on the stationary platen 11 and a movable platen 12 of a die casting machine 10. The die 20 includes a stationary die element 21 mounted on the stationary platen 11 and a movable die element 22 mounted on the movable platen 12 of the die casting machine, which moves the movable die element 22 toward and away from the stationary die element 21. The stationary die element 21 and movable die element 22 include a pair of cavity-forming portions 21*a* and 22*a* respectively. The movable die element 22 carries a plurality of movable slides 23 (shown in FIG. 2), which include cavity-forming portions (not shown). The movable die element 22 also carries internally a plurality of hydraulic piston/cylinder units 24 which move the plurality of slides between their cavity-forming and cavity-open, or part-removal, positions. In FIG.1 the movable die element 22 is illustrated with the cavity-forming slides 23 in their closed cavity-forming positions.

Figure 2A:
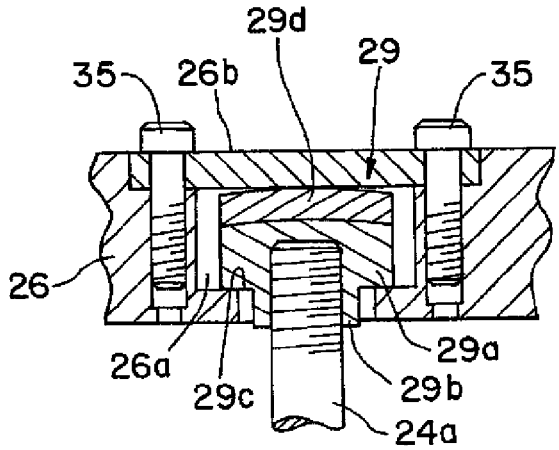
FIG. 2A is a cross-sectional view showing a preferred connection between the piston/cylinder units and the slides.
Figure 2:
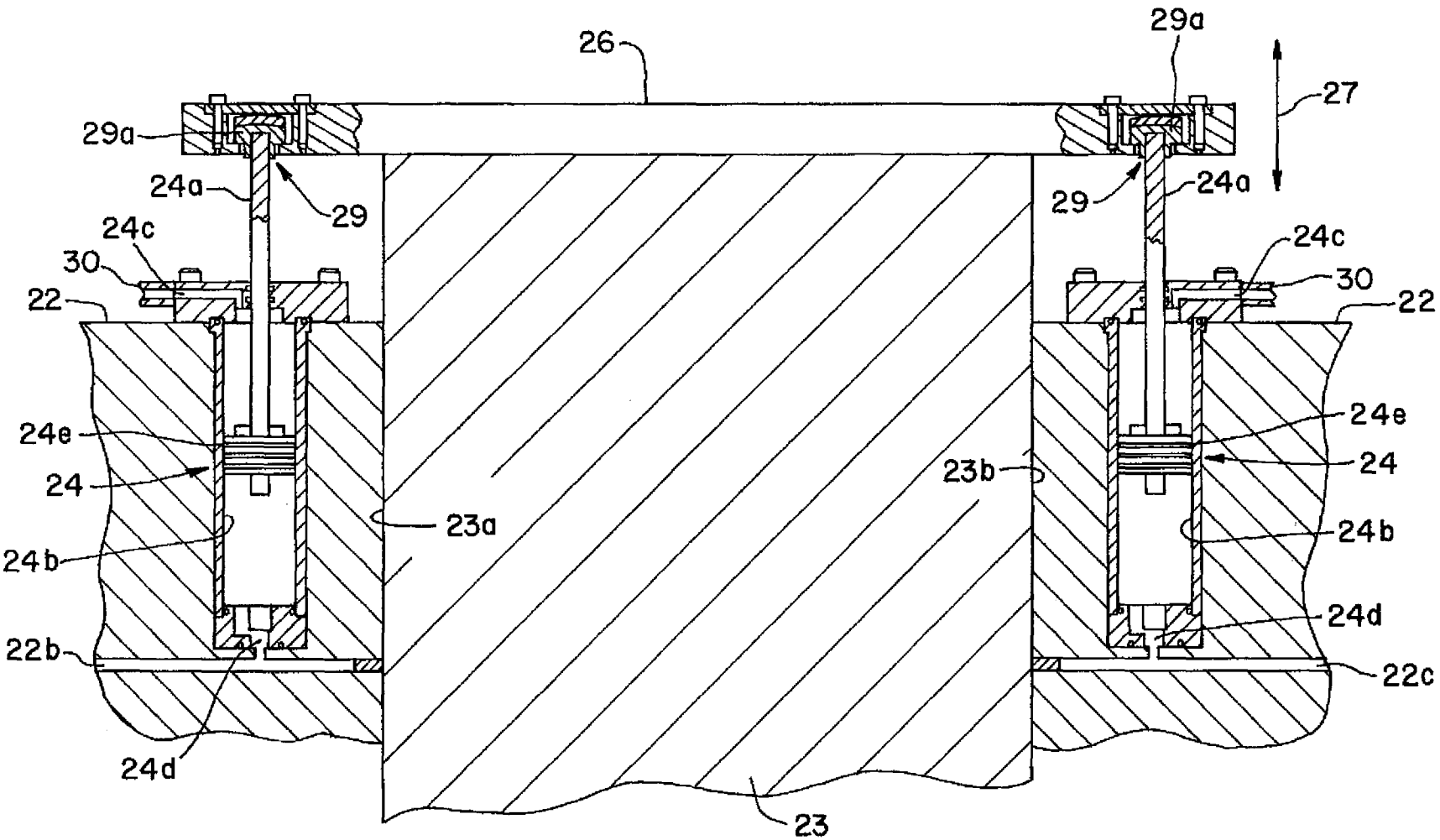
FIG. 2 is a partial cross-section through the die element carried on the movable platen illustrated in FIG. 1 taken at a section indicated by the line 2-2 in FIG. 1, but with the slide partially open to illustrate how the internal piston/cylinder units operate in moving the slides.
Figure 3:
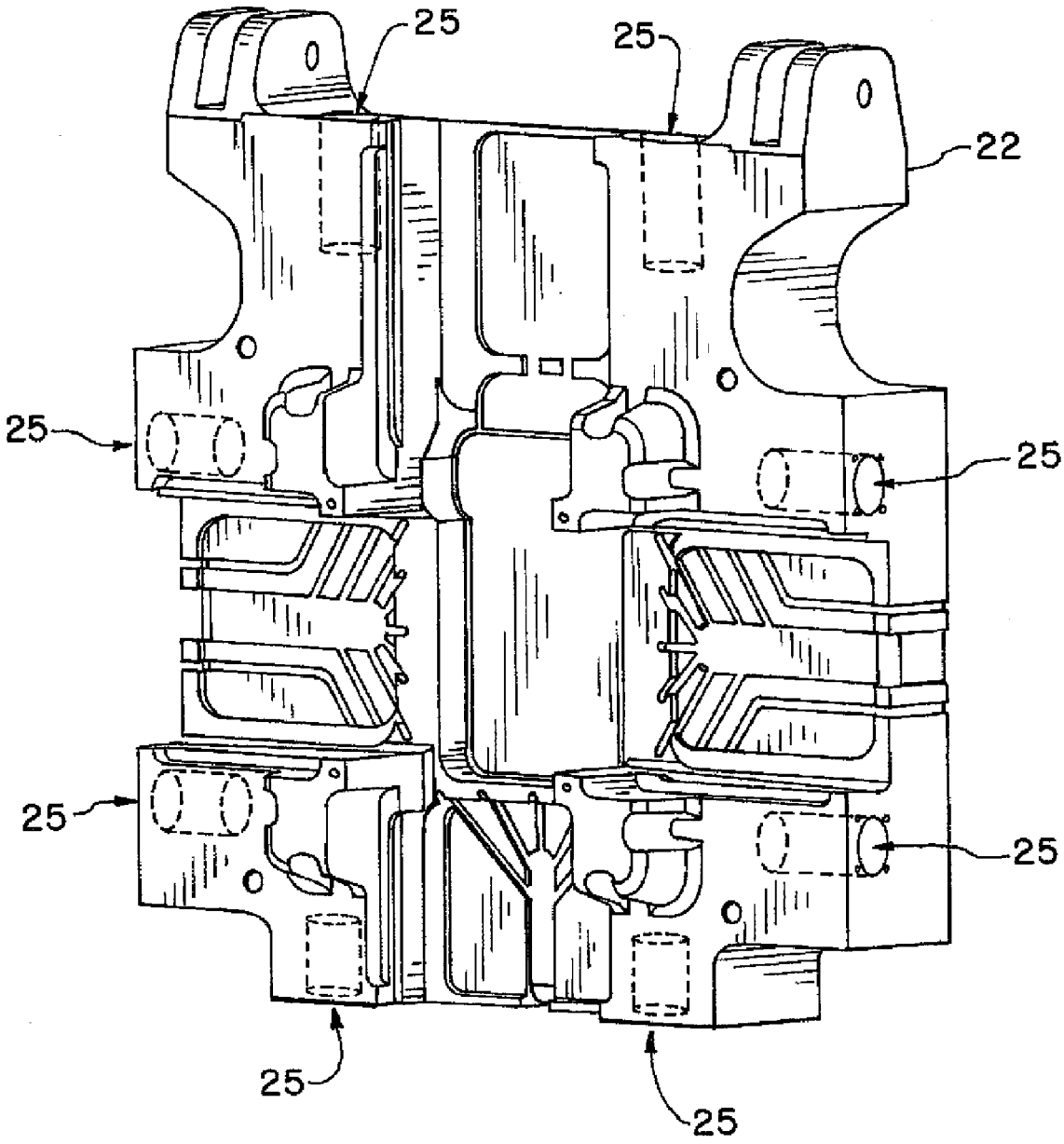
FIG. 3 is a perspective view of a die element which may be mounted on the movable platen of a die casting machine showing a plurality of internal cavities formed for a plurality of piston/cylinder units to be carried within the die element.

As illustrated by FIGS. 1 and 2, and as indicated by FIG. 3, the plurality of hydraulic piston/cylinder units 24 are carried within cylindrical cavities 25 formed in the movable die element 22. Thus, a die 20 of the invention can have a substantially reduced weight compared to prior art dies because of the weight of the steel removed from the movable die element 22 in forming the cavities for the piston/cylinder units 24, and the omission of the heavy structures necessary to carry and support piston/cylinder units outside of the movable die elements of the prior art dies. The reduced weight of a movable die element 22 of the invention reduces the operating forces imposed on a die casting machine and guides in opening and closing the die cavity.

FIG. 2 is a partial cross-sectional view of the movable die element 22 illustrated in FIG. 1, taken at a section corresponding to line 2-2 of FIG. 1, but with the slide 23 having been moved partially to its cavity-open position. As shown in FIG. 2, a pair of piston/cylinder units 24 is carried within the movable die element 22 on opposite sides of the slide 23, with their pair of pistons and rods 24*a* extending therefrom outwardly for movement substantially transversely to the movement of the movable platen (as indicated by arrow 27). As also illustrated in FIG. 2, the slide 23 is attached to an interconnecting element 26 which is driven by the pair of pistons and rods 24*a* substantially transversely in the directions illustrated by arrow 27 to move the slide 23 between its cavity-open position and its cavity-closed position where it is held by engagement with the stationary die element 11 in its cavity-closed position. As indicated in FIG. 2, the interconnecting element 26 is connected adjacent its opposite ends to the pistons and rods 24*a* of a pair of piston/cylinder units 24, the cylinders 24*b* of which are carried within the die element 22. As described in greater detail below, the pistons and rods 24*a* are preferably connected to the interconnecting element 26 by alignment couplers 29. The pistons and rods 24*a* are illustrated in FIG. 2 midway between the extremities of their cylinders 24*b*. When the pistons and rods 24*a* are driven to the bottom of the cylinders 24*b*, the slide 23 will be in its cavity-closed position, and when the pistons and rods 24*a* are driven to the top of the cylinders 24*b*, the slide 23 will be at its cavity-open extremity. The slide 23 is driven to its cavity-closed position by a flow of pressurized hydraulic fluid from connection 30, which is preferably metallic tubing attached with fittings (not shown) to the ports 24*c* of hydraulic piston/cylinder units 24. As the pistons and rods 24*a* are forced downwardly by the pressure and flow of the hydraulic fluid into the ports 24*c*, hydraulic fluid from the other side of the piston 24*a* is forced from within the cylinders 24*b*, out of the other ports 24*d* of the hydraulic piston/cylinder units 24 and into passageways 22*b* and 22*c* formed in the movable die element 22. Conversely, when the slide 23 is moved by the hydraulic piston/cylinder units 24 to its cavity-open position, hydraulic fluid is forced through passageways 22*b* and 22*c* formed in the metallic die element 22 and through the ports 24*d* of the hydraulic piston/cylinder units 24, moving the pistons and rods 24*a* outwardly of the hydraulic piston/cylinder units 24 and driving the interconnecting element 26 and the attached slide 23 outwardly into its cavity-open position. During its movement to the cavity-open position, hydraulic fluid is urged from the cylinders 24*b* of the hydraulic piston/cylinder units 24 outwardly through the ports 24*c* and through the connections 30 to return to the fluid source for the hydraulic pump. The slide 23 is held in its cavity-open position by the continued application of pressurized hydraulic fluid through the passageways 22*b* and 22*c* and the ports 24*d* of the hydraulic piston/cylinder units 24 and into the cylinders 24*b* below the pistons and rods 24*a*.

In the operation of die casting dies there are frequently a holding forces imposed on the cavity-forming surfaces of the slides to hold them in their cavity-closed positions after the cast parts have cooled sufficiently to permit the cavity to be opened. The forces tending to hold the slides in their cavity-closed positions can result from a number of sources such as the contraction of the cooling cast part and adhesion between their cavity-forming surfaces and the cast part. With the invention significantly greater slide opening forces can be generated to overcome such slide holding forces than in the prior art. As apparent from FIG. 2, hydraulic fluid urged into the cylinders 24*b* through ports 24*d* to move the slide 23 to its cavity-open position acts on the entire areas of pistons 24*e*. In prior art dies hydraulic fluid was directed to the sides of the cylinders that included the piston rods, and the area of the pistons which were exposed to the pressure of the hydraulic fluid was thus less, reducing the force that could be developed on the pistons and the slides.

As indicated above, the pistons and rods 24*a* are preferably connected with the interconnecting elements 26 and slides 23 by alignment couplers 29, particularly when the slides 23 extend outwardly from the sides of the movable die element 22 where gravity exerts a downward force on the extended slides that may displace the slides 23 several degrees downwardly from their designed extended positions perpendicular to the movable die element 22. In the absence of the alignment couplers 29, the weight of an interconnecting element 26 and slide 23 would produce a bending force on the piston and rods 24*a*. As illustrated in FIG. 2A, the alignment couplers 29 float within pockets 26*a* formed in the interconnecting element 26 and include coupler elements 29*a* with internally threaded shanks 29*b* that can be threaded onto the ends of the piston and rods 24*a*. The threaded shanks 29*b* are smaller than bottom openings of the pockets 26*a* into which they extend, but the coupler elements 29*a* have bottom surfaces 29*c* that are larger than the bottom openings of the pockets 26*a* and provide engagement surfaces to drive the slides 23 inwardly. The pockets 26*a* are closed at their tops by plates 26*b* and threaded fasteners 35. By removing the threaded fasteners 35 and plates 26*b*, the alignment couplers 29 can be threaded onto the threaded ends of the pistons and rods 24*a*. By replacing the plates 26*b* and threaded fasteners 35, the connection between the piston/cylinder units 24 and the interconnecting element 23 is complete. The alignment couplers 29 may also have arcuate lubricious elements 29*d* at their upper surfaces that provide engagement surfaces to drive the slides 23 outwardly. As apparent from FIG, 2A, except for the engagement of the alignment couplers 29 with the attached plates 29*b* at their tops and engagement of the bottom surfaces of the threaded shanks 29*b* with the bottom surfaces of pockets 26*a*, the alignment couplers are free of any contact with the interconnecting elements 26 that may result from angular variations between the interconnecting element 26 and the pistons and rods 24*a*. Thus, the use of alignment couplers 29 prevents the imposition of harmful bending forces on the piston/cylinder units 24 that may result from the extended weight of a slide 23 and interconnecting element 26 and also accommodates any angular displacement of the slides 23 that may be produced by an unequal application of forces by a driving pair of piston/cylinder units 24.

A further feature of the invention is the ability to remove a slide 23 without affecting the piston/cylinder units 24. Removal of the threaded fasteners 35, the plates 26*b*, and the alignment couplers 29 of a slide 23 permits the interconnecting element 26 and the slide 23 to be removed from the pistons and rods 24*a* and from the movable die element 22 without removal of the conduits for the hydraulic fluid to the cylinders, e.g. connectors 30, or otherwise affecting the piston/cylinder units 24.

While FIG. 2 illustrates only one of the plurality of slides 23 and a pair of driving piston/cylinder units 24, FIG. 2 illustrates the manner in which each of the plurality of the slides 23 carried by a movable die element 22 is operated. As indicated by FIG. 3, a movable die element 22 may be provided with the plurality of cavities 25, located in pairs on the opposite sides of each of the plurality of slides (not shown) to drive each of the plurality slides in the same manner as illustrated in described above with respect to FIG. 2. The cylindrical cavities 25, as illustrated in FIG. 3, are located in the portions of a die, such as movable die element 22, where temperature is normally not a factor in the reliability and life of the hydraulic cylinders although they are carried within the movable die element. While not illustrated herein, the slides of a movable die element may be driven by single piston/cylinder units carried within the die element, but this is not preferred because the offset location of a single piston/cylinder unit from the slide it drives necessarily imposes unbalanced forces of the pistons and rods of the piston/cylinder units.

As indicated above, in the operation of die casting dies, the person operating the dies sometimes operates the hydraulic system for the piston/cylinder units to provide a sudden application of hydraulic pressure to the piston/cylinder units in an effort to dislodge cast parts that may be stuck in the die cavity. As shown in FIG. 2, the hydraulic fluid is preferably connected to the plurality of piston/cylinder units 24 by metallic tubing exterior to the movable die element 22 (e.g. 30) and by passageways formed within the movable die element 22 (e.g. 22*b*, 22*c*). The invention thus results in an elimination of a substantial portion of the hydraulic hoses that have been used to deliver hydraulic fluid to the hydraulic piston/cylinder units, resulting in a reduced possibility in the instance of hydraulic hose failures in operation of the die. In addition, the substantial reduction in substantially flexible and expandable hydraulic hoses can substantially eliminate the absorption by the hydraulic hoses of the sudden application of pressure by an equipment operator as a result of the absorption of the imposed pressure energy by the expansion of the flexible hydraulic lines, and permits the transmission of a more sudden application of forces to the slides and an increased possibility that the operator may dislodge cast parts that remain in the die cavity.

While cracking of the movable die elements is infrequent, placing a substantial portion of the hydraulic fluid passageways within the movable die element increases their exposure to the effects of die cracking and the possibility of hydraulic fluid leaks and pressure losses. This problem can be prevented in the invention by lining the hydraulic fluid passageways within the movable die element, for example, passageways 22*b* and 22*c* in FIG. 2, with tubing of a compliant material, such as a VITON™ or high temperature rubber, which will maintain the integrity of the passageways in the event the movable die element forms a crack that intercepts a passageway.

Thus, the invention provides a die that is lighter and has a reduced profile than prior art dies and is more easily fit to a larger variety of die casting machines and may be more easily and reliably connected with a hydraulic pump or other source of hydraulic pressure.

Where this description refers to movements "substantially transversely" with respect to the movement of the movable platen of a die casting machine, it means movements proximate to 90° with respect to the movement of the movable platen, that is, movements within only a few degrees of 90° with respect to the direction of movement of the movable platen. And wherein the term "compliant" is used with respect to the properties of a lining for the passageways formed in the movable die element, it means a material that remains plastic in this application and will retain its integrity if the surrounding metal cracks or becomes dislodged.

While the figures and descriptions above illustrate and describe preferred embodiments, other embodiments of the invention will be apparent to those skilled in the art that come within the spirit of the invention as defined by the following claims.

What is claimed is:

1. A die for die casting a metal part, comprising:

a stationary die element including a cavity-forming surface for mounting on the stationary platen of a die-casting machine; and a movable die element for mounting on the movable platen of a die-casting machine for movement into cavity-forming engagement with said stationary die element, said movable die element including a cavity-forming surface portion, and carrying a plurality of slides including cavity-forming surfaces for movement substantially transversely with respect to the movement of the movable platen between cavity-forming positions and part-removal positions, and a plurality of hydraulic piston/cylinder units with their cylinders carried internally within the movable die element and their pistons extending outwardly from within the movable die element, said pistons having, at their extending ends, interconnecting means, said interconnecting means being connected with and driving the plurality of slides substantially transversely with respect to the movement of the movable platen between their cavity-forming positions and part-removal positions.

2. The die of claim 1, wherein each of the plurality of slides is driven by the pistons of a pair of hydraulic piston/cylinder units.

3. The die of claim 2, wherein the cylinders of each pair of hydraulic piston/cylinder units driving each of the plurality of slides are carried within the movable die element adjacent the opposite sides of each slide with their pistons extending outwardly therefrom on opposite sides of the slide for movement substantially transversely to the movement of the movable platen, and wherein said interconnecting means connects the pair of pistons and the slide.

4. The die of claim 1, wherein the movable die element also includes means for carrying a driving flow of hydraulic fluid to the plurality of piston/cylinder units from a source of hydraulic power including a plurality of hydraulic fluid passageways formed within the movable die element.

5. The die of claim 1, further comprising at least a pair of cylinder-forming die core pieces carried by the movable die element for reciprocation at acute angles with respect to the movement of the movable platen between extended positions within the die cavity and retracted positions outside of the die cavity, and die core locking means movably carried within the movable die element to a die core piece locking position.

6. The die of claim 5, wherein the die core locking means comprises a die core locking member reciprocatably carried within the movable die element along the axis of movement of the movable platen and operable in its forwardmost position to engage rear portions of the die core pieces and lock the die core pieces in their extended positions.

7. The die of claim 5, wherein the die core locking member is carried by the movable die element for reciprocatable movement within a cavity formed by the movable die element, said cavity having an open front portion into which the rear portions of the die core elements move in their extended positions, and including a rear surface.

8. The die of claim 7, wherein the cavity formed by the movable die element further contains a pair of lock elements reciprocatably carried for movement transverse to the movement of the die core locking member between inward positions between the die core locking member and the cavity rear surface, thereby preventing movement of the die core pieces within the die cavity, and outward positions permitting the die core locking element to disengage from the die core pieces and retraction of the die core pieces.

9. The die of claim 4, wherein the passageways formed within the movable die element are lined with compliant tubing.

10. A die for die casting a metal part, comprising:

a plurality of die elements and a plurality of slides, said die elements and slides being operable between closed cavity-forming positions and open part-removal positions, said plurality of slides being moved between their cavity-forming and part-removal positions by a plurality of piston/cylinder units having cylinders and piston-driven rods;

each of a plurality of slides being moved by an adjacent pair of the plurality of piston/cylinder units having their cylinders carried within a die element with their piston-driven rods extending from the die element to an extending end;

each slide being connected to the extending rods of the adjacent pair of piston/cylinder units, by an interconnecting element, each interconnecting element having a pair of pockets for receipt of the extending ends of the pair of extending rods, each said pocket having a bottom opening for each of the piston-driven rods of the adjacent pair of piston/cylinder units, said bottom opening providing a clearance space around the piston-driven rods, and a pair of fasteners, accessible from outside of the interconnecting element, connecting the extending rods of the adjacent pair of piston/cylinder units with the interconnecting element so that removal of the fasteners permits the interconnecting element and slide to be removed from the die without work on the piston/cylinder units.

11. The die of claim 10, wherein the fasteners comprise alignment couplers connected to the extending rods of the adjacent pairs of piston/cylinder units and carried within the pockets.

12. In a die for die casting a metal part including a stationary die element, a movable die element, and plurality of movable slides forming a cavity for casting the part, and a plurality of pairs of hydraulic piston/cylinder units connected to drive the movable slides between cavity-forming and part-removal positions, the improvement wherein the plurality of pairs of hydraulic piston/cylinder units include cylinders carried within the movable die element with their pistons extending outwardly from the movable die element and connected in pairs with the movable slides, the movable slides being carried by the movable die element between the pairs of piston/cylinder units, said slides being connected with the pairs of pistons by interconnecting elements, said interconnecting elements providing pockets for connection with the pairs of pistons, said pockets having open tops and bottom openings, the open tops of the pockets being closable by plates fastenable to the interconnecting element, said pairs of pistons being engaged at their extending ends with couplers within the pockets of the interconnecting element, said open tops of the pockets of the interconnecting elements permitting the couplers to be engaged with and disengaged from the ends of the pistons, said pockets endplates providing engagement surfaces for the couplers permitting the slides to be driven between their cavity-forming and part-removal positions, removal of the plates from the interconnecting element permitting removal of the interconnecting elements and the slides from the die without disconnecting the piston/cylinder units.

13. The die of claim 12, wherein the couplers for the interconnecting elements are alignment couplers.

14. A die for die casting a metal part, comprising:

a stationary die element including a cavity-forming surface for mounting on the stationary platen of a die-casting machine; and a movable die element for mounting on the movable platen of a die-casting machine for movement into cavity-forming engagement with said stationary die element, said movable die element including a cavity-forming surface portion, and carrying a plurality of slides including cavity-forming surfaces for movement substantially transversely with respect to the movement of the movable platen between cavity-forming positions and part-removal positions, and a plurality of hydraulic piston/cylinder units with their cylinders carried internally within the movable die element and their pistons extending outwardly from within the movable die element for connection at their extending ends with the plurality of slides, and interconnecting means between the extending ends of the pistons and the plurality of slides for driving the slides between their part-forming and part-removal positions without imposing bending forces on the hydraulic piston/cylinder units.

15. The die of claim 14 wherein the interconnecting means comprise interconnecting elements connected between extending ends of the pistons of the hydraulic piston/cylinder units and the slides and including pockets, said pockets enclosing interconnecting couplers at the ends of the extending pistons.

16. The die of claim 15 wherein the pockets form bottom openings through which the extending pistons pass, and said pockets, interconnecting couplers, and pistons are free of any contact resulting from angular variations between the interconnecting elements and the extending pistons.

17. The die of claim 16 wherein the interconnecting couplers are alignment couplers.

* * * * *

UNITED STATES PATENT AND TRADEMARK OFFICE

CERTIFICATE OF CORRECTION

PATENT NO. : 7,766,073 B2
APPLICATION NO. : 11/761442
DATED : August 3, 2010
INVENTOR(S) : Gregg Edward Whealy It is certified that error appears in the above-identified patent and that said Letters Patent is hereby corrected as shown below:

In the Claims

In Column 8, Line 66, delete "endplates" and insert --and plates--.

Signed and Sealed this

Second Day of November, 2010

David J. Kappos

David J. Kappos
*Director of the United States Patent and Trademark Office*